US007324776B2

(12) United States Patent
Hirota et al.

(10) Patent No.: US 7,324,776 B2
(45) Date of Patent: Jan. 29, 2008

(54) IMAGE FORMING APPARATUS, CHARGE CONTROLLING APPARATUS, AND IMAGE FORMING METHOD

(75) Inventors: Akira Hirota, Okazaki (JP); Hiroaki Umemoto, Neyagawa (JP); Noritoshi Hagimoto, Toyohashi (JP); Kuniya Matsuura, Toyohashi (JP); Naotoshi Kawai, Toyokawa (JP); Kentaro Katori, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 145 days.

(21) Appl. No.: 11/028,746

(22) Filed: Jan. 5, 2005

(65) Prior Publication Data

US 2006/0083548 A1 Apr. 20, 2006

(30) Foreign Application Priority Data

Oct. 20, 2004 (JP) ..... 2004-305135

(51) Int. Cl.
*G03G 21/00* (2006.01)

(52) U.S. Cl. ..... 399/129

(58) Field of Classification Search ..... 399/129
See application file for complete search history.

(56) References Cited

U.S. PATENT DOCUMENTS 5,481,351 A * 1/1996 Kawai et al. ..... 399/359
5,619,308 A * 4/1997 Kinoshita et al. ..... 399/48
6,952,546 B2 10/2005 Yoshikawa
2004/0258430 A1* 12/2004 Ishii et al. ..... 399/89

FOREIGN PATENT DOCUMENTS

| | | |
|---|---|---|
| JP | 10-003197 A | 1/1998 |
| JP | 2001-255799 | 9/2001 |
| JP | 2002-372878 | 12/2002 |
| JP | 2002-372878 A | 12/2002 |
| JP | 2003-167476 | 6/2003 |
| JP | 2004-117960 A | 4/2004 |

OTHER PUBLICATIONS

Japanese Office Action dated Oct. 16, 2007, directed to counterpart Japanese Application No. 2004-305135 (5 pages).

* cited by examiner

*Primary Examiner*—Vincent Q Nguyen
(74) *Attorney, Agent, or Firm*—Morrison & Foerster LLP

(57) ABSTRACT

A color printer including, a conductive brush roller to contact a photosensitive drum at a position downstream of a transferring apparatus and upstream of a charging apparatus, wherein at least part of residual toner is collected after temporarily transferring on the photosensitive drum, and the collected toner is expelled onto the photosensitive drum, a charge electrode facing the brush roller at a position other than the contact position of the photosensitive drum and the brush roller, and a power source to apply voltage to the charge electrode, wherein the polarity of the voltage applied from the power source to the charge electrode with respect to the average voltage of the surface of the photosensitive drum after transferring is the same as a charging polarity of the toner at developing.

23 Claims, 5 Drawing Sheets

FIG. 5

| | ENVIRONMENT | V0[V] | V1[V] | Vpp[V] | V2[V] | -Q0[μC] | -Q1[μC] | IMAGE DEFECT DUE TO TONER DROP | UNEVENNESS OF DENSITY DUE TO DIRT ON CHARGING ROLLER | IMAGE NOISES DUE TO MISEXPOSURE |
|---|---|---|---|---|---|---|---|---|---|---|
| EXPERIMENT 1 | RT | 0 | -100 | 400 | -500 | 30 | 30 | ○ | ○ | ○ |
| EXPERIMENT 2 | RT | 0 | -200 | 600 | -700 | 30 | 40 | ○ | ○ | ○ |
| EXPERIMENT 3 | RT | 0 | -300 | 800 | -900 | 30 | 50 | ○ | ○ | ○ |
| EXPERIMENT 4 | RT | -100 | -200 | 400 | -500 | 30 | 40 | ○ | ○ | ○ |
| EXPERIMENT 5 | RT | -100 | -300 | 600 | -700 | 30 | 50 | ○ | ○ | ○ |
| EXPERIMENT 6 | RT | -100 | -400 | 800 | -900 | 30 | 60 | ○ | ○ | ○ |
| EXPERIMENT 7 | LL | 0 | -200 | 600 | -700 | 40 | 50 | ○ | ○ | ○ |
| EXPERIMENT 8 | LL | -100 | -300 | 600 | -700 | 40 | 60 | ○ | ○ | ○ |
| EXPERIMENT 9 | HH | 0 | -200 | 600 | -700 | 20 | 30 | ○ | ○ | ○ |
| EXPERIMENT 10 | HH | -100 | -300 | 600 | -700 | 20 | 40 | ○ | ○ | ○ |
| EXPERIMENT 11 | RT | -100 | -200 | 400 | -1200 | 30 | 80 | ○ | ○ | △ |
| EXPERIMENT 12 | RT | -100 | 0 | 400 | -400 | 30 | 40 | △ | ○ | ○ |
| EXPERIMENT 13 | RT | -100 | -300 | 400 | 0 | 30 | 20 | × | △ | ○ |
| EXPERIMENT 14 | LL | -100 | -400 | 800 | -1200 | 40 | 90 | ○ | ○ | △ |
| EXPERIMENT 15 | LL | -100 | 0 | 400 | -400 | 40 | 50 | △ | ○ | ○ |
| EXPERIMENT 16 | LL | -100 | -300 | 400 | 0 | 40 | 30 | × | ○ | ○ |
| EXPERIMENT 17 | HH | -100 | -400 | 800 | -1200 | 20 | 70 | ○ | ○ | △ |
| EXPERIMENT 18 | HH | -100 | 0 | 400 | -400 | 20 | 30 | △ | ○ | ○ |
| EXPERIMENT 19 | HH | -100 | -300 | 400 | 0 | 20 | 10 | × | × | ○ |
| EXPERIMENT 20 | HH | -100 | -300 | 400 | +200 | 20 | 10 | × | × | ○ |

IMAGE FORMING APPARATUS, CHARGE CONTROLLING APPARATUS, AND IMAGE FORMING METHOD

This application is based on Application No. 2004-305135 filed in Japan, contents of which are hereby incorporated by reference.

BACKGROUND OF THE INVENTION

1. Field of the Invention

The present invention relates to an image forming apparatus such as a printer and a copier, a charge controlling apparatus, and an image forming method of an electro photographic type. More particularly, it relates to an image forming apparatus called cleaner-less type not having cleaning apparatus for scrapping residual toner on an image carrier and a charge controlling apparatus used therein, and an image forming method thereof.

2. Description of the Related Art

Hitherto, a printer, a copier, and other image forming apparatuses of an electro photographic type have been known. In such image forming apparatuses, generally, a toner image is formed on an image carrier such as a photosensitive drum. This toner image is transferred onto a to-be-transferred body, and an image is obtained. A conventional image forming apparatus is provided with a blade or the like for scraping off residual toner from the image carrier after transfer. The scraped toner has been generally scrapped. By contrast, image forming apparatuses called cleaner-less type have been recently proposed (for example, see Japanese Laid-open Patent Publication No. 2003-167476).

A cleaner-less image forming apparatus does not comprise a cleaning apparatus including a blade. That is, residual toner on an image carrier after transfer is not scraped. While being mounted on the image carrier, the residual toner passes through a charging apparatus and an exposure apparatus. The residual toner is collected by a developing apparatus, and recycled. The cleaner-less image forming apparatus has been devised for the purpose of decreasing waste toner and miniaturization of the apparatus.

Further, in the image forming apparatus disclosed in Japanese Laid-open Patent Publication No. 2003-167476, residual-toner-dispersing means and toner-charge-quantity controlling means are provided at the downstream side of the transferring apparatus. These means have brushes for example. The dispersion state and charge quantity of residual toner are adjusted. In the toner-charge-quantity controlling means, moreover, a bias is applied to render the residual toner in same polarity as toner at developing.

The residual toner may be excessive and may form lumps locally. Toner of opposite polarity may be contained occasionally. In order to collect the residual toner securely in spite of these circumstances, an image forming apparatus has been proposed (see, for example, Japanese Laid-open Patent Publication No. 2002-372878). This image forming apparatus has a brush roll contacting with the image carrier. By rotation of this brush roll, residual toner on the image carrier is leveled. A bias voltage is applied to the brush roll and its covering case. Thus, toner charged in opposite polarity is collected to the brush roll.

However, in the image forming apparatus disclosed in Japanese Laid-open Patent Publication No. 2003-167476, it has been difficult to control the voltage of the toner-charge-quantity controlling means. For example, to control the toner in a specified charged state, it is required to apply a strong bias to the toner-charge-quantity controlling means. However, it may cause nonuniform charge of photosensitive drum. On the other hand, to avoid nonuniform charge of photosensitive drum, a moderate bias needs to be applied by the toner-charge-quantity controlling means. In this case, the toner may not be adjusted well to a desired charged state.

At the same time, the toner-charge-quantity controlling means also receives a bias for collecting the residual toner. It is hence hard to expel the toner. In the event of expelling trouble, toner may be accumulated in the toner-charge-quantity controlling means. If toner is accumulated, the charge control function of the toner-charge-quantity controlling means may be lowered.

Besides, in the image forming apparatus disclosed in Japanese Laid-open Patent Publication No. 2002-372878, toner charged in opposite polarity is separated from the toner of normal or original polarity and captured. It is then scrapped. It is intended to prevent the toner of opposite polarity from being carried by the image carrier to reach the position facing the charging apparatus. The toner of opposite polarity may be adhered to the charging member. However, the toner of opposite-polarity can be recycled if the charge is adjusted again. It has been therefore demanded to decrease quantity of the waste toner.

Charging state of residual toner also tends to differ depending on the operating environments. Further, as compared with the general charge quantity of toners in the developing apparatus, fluctuations are larger. If such residual toner is merely set opposite to the developing apparatus, it may cause collection troubles. For example, if the charge quantity of the residual toner is too high, the adhesive power to the image carrier is too strong. Hence, it may not be collected by the developing apparatus.

To the contrary, the toner of opposite polarity or of extremely low charge quantity may contaminate the charging member in the process of conveying. In particular, toner adhesion is likely to occur in the contact type charging member such as charging roller. On the other hand, the contact-type charging member is small in ozone-emission quantity as compared with non-contact-type charging member such as corona charging-type. Accordingly, it has a merit of omitting ozone filter and the like. That is, it has been demanded because it suits downsizing of the apparatus.

SUMMARY OF THE INVENTION

The present invention has been made in view of the above circumstances and has an object to overcome the above problems and to provide an image forming apparatus of a cleaner-less type using a contact type charging apparatus, and more particularly an image forming apparatus capable of collecting residual toner securely in a developing apparatus without contaminating the charging apparatus. It is also intended to provide a charge controlling apparatus and an image forming method in the image forming apparatus.

To achieve the purpose of the invention, there is provided an image forming apparatus comprising: a photosensitive body; a charger which charges a surface of the photosensitive body; an exposure apparatus which forms an electrostatic latent image on the surface of the photosensitive body; a developing apparatus which develops an electrostatic latent image of the photosensitive body by toner; a transferring apparatus which transfers a toner image on the photosensitive body onto a to-be-transferred body; a contact-rotating member which is conductive and contacts with the photosensitive body at a position downstream of the transferring apparatus and upstream of the charger in respect to a moving direction of the surface of the photosensitive body, collecting temporarily at least part of toner remaining on the photosensitive body without being transferred, and expelling the collected toner onto the photosensitive body; an electrode facing the contact-rotating member at a position other than the contact position of the contact-rotating member with the photosensitive body; and a first voltage applying section which applies voltage to the electrode, wherein polarity of the voltage applied to the electrode by the first voltage applying section with respect to an average voltage of the surface of the photosensitive body after transferring is the same as charging polarity of the toner at developing.

According to another aspect, the invention provides a charge controlling apparatus which adjusts charge of toner on a photosensitive body comprising: a contact-rotating member which is conductive and is provided in contact with a photosensitive body, collecting temporarily at least part of toner on the photosensitive body, and expelling the collected toner onto the photosensitive body; an electrode facing the contact-rotating member at a position other than the contact position of the contact-rotating member with the photosensitive body; and a first voltage applying section which applies voltage to the electrode, wherein polarity of the voltage applied to the electrode by the first voltage applying section with respect to an average voltage of the surface of the photosensitive body after transferring is the same as charging polarity of toner at developing.

According to another aspect, the invention provides an image forming method comprising the steps of: charging a surface of a photosensitive body; forming an electrostatic latent image on the surface of the photosensitive body by exposure; forming a toner image by developing the electrostatic latent image on the photosensitive body; transferring the toner image on the photosensitive body onto a to-be-transferred body; collecting temporarily at least part of the toner remaining on the photosensitive body without being transferred, by a contact-rotating member provided in contact with the photosensitive body; applying voltage to an electrode facing the contact-rotating member at a position other than the contact position of the contact-rotating member with the photosensitive body; and expelling the toner collected by the contact-rotating member onto the photosensitive body, wherein polarity of the voltage applied to the electrode with respect to the average voltage of the surface of the photosensitive body after transferring is the same as charging polarity of toner at developing.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings,

FIG. 5 is an explanatory diagram of results of image evaluation.

DETAILED DESCRIPTION OF THE PREFERRED EMBODIMENTS

A preferred embodiment of the invention is described specifically below while referring to the accompanying drawings. This embodiment is an application of the invention in a cleaner-less-type color printer.

Figure 1:
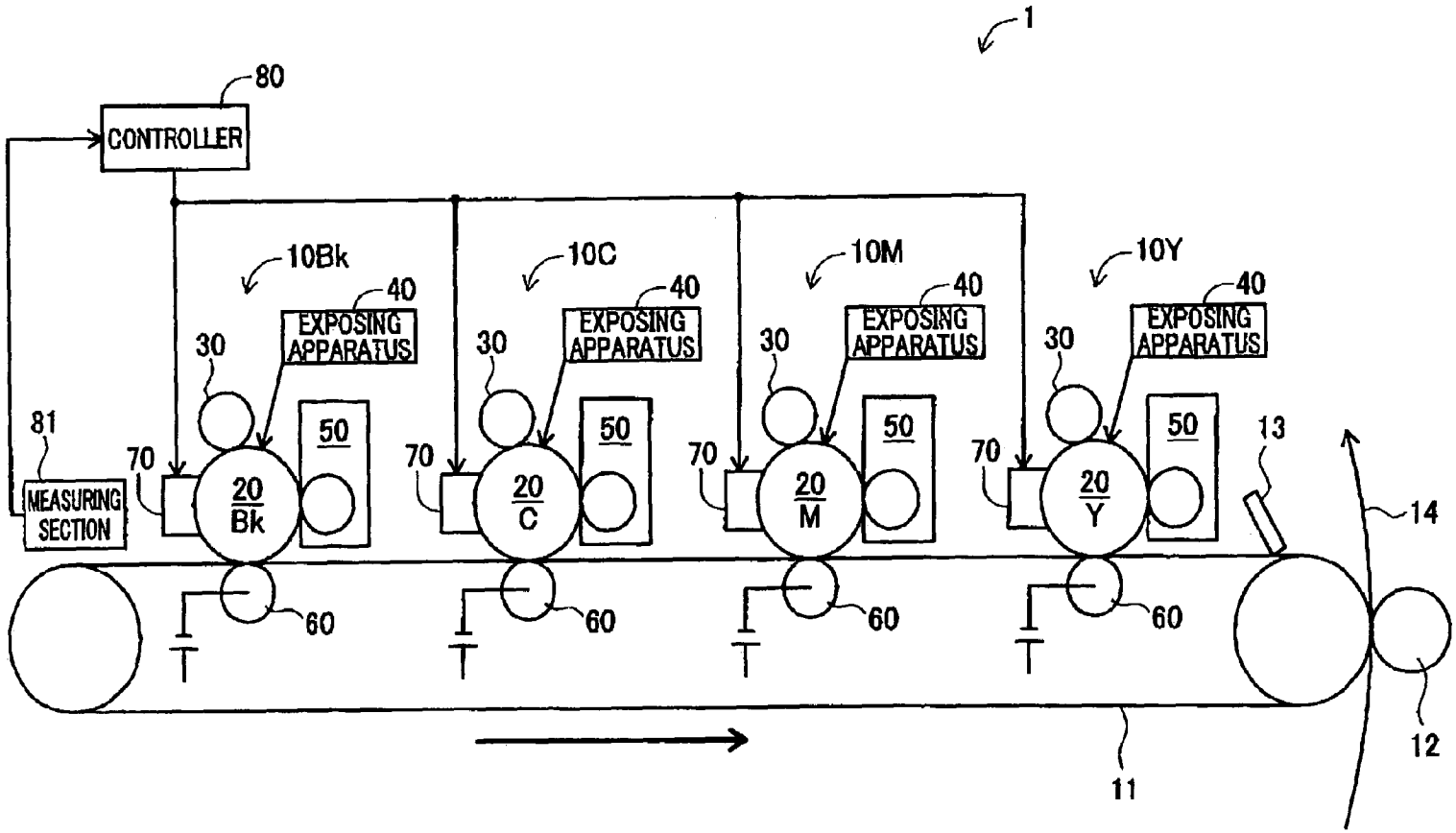
FIG. 1 is a block diagram of principal parts of color printer of an embodiment.

A color printer 1 of the embodiment has color image forming sections 10Y, 10M, 10C, and 10Bk as shown in a block diagram in FIG. 1. The color printer 1 further comprises an intermediate transfer belt 11, a secondary transfer apparatus 12, and a belt cleaner 13. Color image forming sections 10Y, 10M, 10C, and 10Bk are disposed along the intermediate transfer belt 11. Color toner images are overlaid and formed on the intermediate transfer belt 11. The overlaid toner images are transferred onto a recording sheet 14 by means of the secondary transfer apparatus 12. Toner remaining on the intermediate transfer belt 11 is scraped off by a belt cleaner 13. Hereinafter, unless otherwise necessary, color subscripts Y, M, C, and Bk are omitted.

Figure 2:
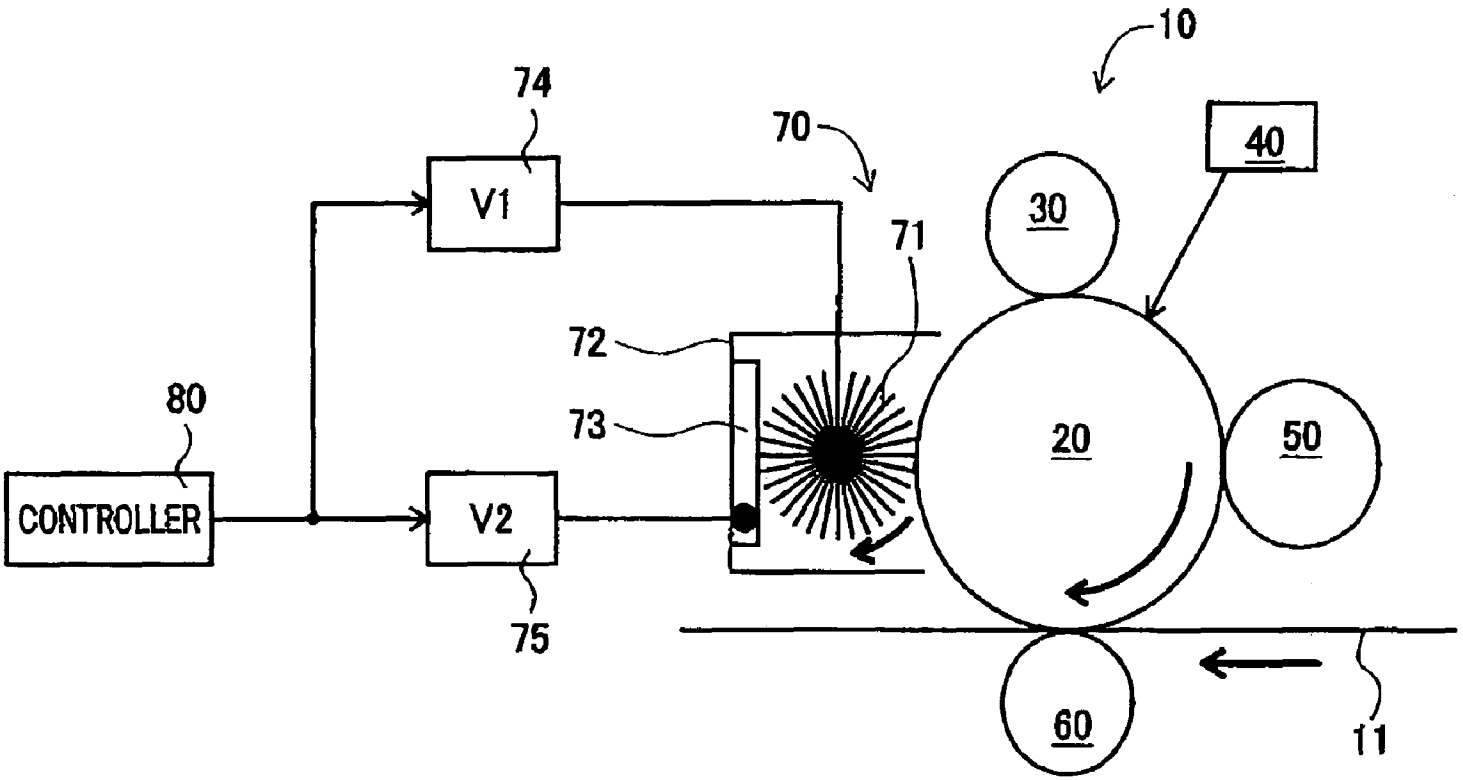
FIG. 2 is a block diagram of each image forming section of various colors.

Color image forming sections 10 are identical in structure. Each image forming section 10 comprises, as shown in FIG. 1 and FIG. 2, a photosensitive drum 20, which is surrounded by a charging apparatus 30, an exposing apparatus 40, a developing apparatus 50, and a transferring apparatus 60. As the charging apparatus 30, a contact type charging roller is used. The developing apparatus 50 uses negatively-charged-type toner. Other apparatuses are ordinary ones. In the color printer 1 of the embodiment, a charge controlling section 70 is further provided between the transferring apparatus 60 and charging apparatus 30.

The color printer 1 of the embodiment further includes a controller 80 and an environment measuring section 81. The controller 80 controls the charge controlling sections 70 of colors. The environment measuring section 81, which may comprise an environmental sensor 82, measures, for example, the temperature and the humidity in the color printer 1 during operation. Results of measurement by the environment measuring section 81 are put into the controller.

The charge controlling section 70 includes, as shown in FIG. 2, a brush roller 71, a case 72, and a charge electrode 73. They are provided so that their latitudinal direction is parallel to the axial direction of the photosensitive drum 20. They cover at least the entire image forming width of the photosensitive drum 20. Power sources 74, 75 are connected to the brush roller 71 and to the charge electrode 73. As a result, different voltages can be applied. The controller 80 controls the power sources 74, 75. Thus, the voltages applied to the brush roller 71 and to the charge electrode 73 are controlled appropriately.

The brush roller 71 has conductive and elastic linear members planted on the periphery of rotary shaft. Instead of the brush roller 71, a sponge roller may be used. The brush roller 71 is mounted rotatably around the rotary shaft. The tips of linear members of the brush roller 71 are in contact with the surface of the photosensitive drum 20. The case 72 is formed like a box covering the brush roller 71, except for the side facing the photosensitive drum 20. The case 72 is disposed so as not to contact with the photosensitive drum 20.

The charge electrode 73 is a conductive member formed like a band in the axial direction of the photosensitive drum 20. The charge electrode 73 is fixed inside of the case 72. That is, the charge electrode 73 is facing the brush roller 71. The charge electrode 73 is disposed so as not to contact with the photosensitive drum 20. The charge electrode 73 and brush roller 71 may either contact or not contact with each other. In case the brush roller 71 is in contact with the charge electrode 73, its invasion quantity there should be smaller than that on the photosensitive drum 20.

Next, the operation of the image forming sections 10 in the color printer 1 of the embodiment is explained. The surface of the photosensitive drum 20 is uniformly charged by the charging apparatus 30. Then, an electrostatic latent image according to image data is formed by the exposing apparatus 40. The electrostatic latent image formed is developed by the developing apparatus 50, and a toner image is formed. Further, it is transferred onto the intermediate transfer belt 11 by the transferring apparatus 60. At this time, toner not transferred onto the intermediate transfer belt 11 and remaining on the photosensitive drum 20 is the residual toner.

The residual toner faces the charge controlling section 70 as the photosensitive drum 20 further rotates. At this time, the brush roller 71 of the charge controlling section 70 rotates in the counter-direction to the rotation of the photosensitive drum 20 as shown in FIG. 2. Further the tips of linear members of the brush roller 71 contact with the surface of the photosensitive drum 20. As a result, the residual toner on the surface of the photosensitive drum 20 is rubbed out uniformly by the brush roller 71.

Furthermore, to the brush roller 71, a superimposed voltage of direct current and alternating current is applied from the power source 74. The applied voltage value in the brush roller 71 is set in a specified range with respect to the surface potential of the photosensitive drum 20. To the charge electrode 73, on the other hand, an only direct-current voltage is applied from the power source 75. This applied voltage value is controlled by the controller 80 depending on the condition such as operation environment.

Hereinafter, the voltages applied to the brush roller 71 and to the charge electrode 73 are specifically described. Suppose the average surface potential of the photosensitive drum 20 after transferring to be V0, the average voltage applied to the brush roller 71 to be V1, and the voltage applied to the charge electrode 73 to be V2. These three voltages are of the same polarity with respect to the ground voltage. Since negatively-charged-type toner is used in the developing apparatus 50, herein, these voltages are all negative. The absolute values of these voltages are set to satisfy the relation in formula (1) below.

$$|V0|<|V1|<|V2| \quad (1)$$

Specifically, V0 corresponds to the "average voltage of the surface of the photosensitive body after transferring", V1 to the "average voltage that the second voltage applying section applies to the contact-rotating member", and V2 to the "voltage that the first voltage applying section applies to the electrode". Since |V0|<|V1| in formula (1), toner is transferred more smoothly from the photosensitive drum 20 to the brush roller 71. Moreover, since |V1|<|V2|, the charge quantity of the toner adhering to the brush roller 71 is controlled appropriately, and the toner is transferred smoothly from the brush roller 71 to the photosensitive drum 20. As a result, accumulation of toner on the brush roller 71 is prevented, and occurrence of defective image due to spilt toner can be suppressed.

Peaks of voltages applied to the brush roller 71 are supposed to be V1*p*, V1*q*. The voltage applied to the brush roller 71 varies between V1*p* and V1*q*. This range is determined to satisfy the relation in formula (2) below.

$$|V1p|<|V0|<|V1|<|V1q|<|V2| \quad (2)$$

Further, V1*p* and V1*q* are set to an extent not to change the charging state of the photosensitive drum 20. Incidentally, V1*p* may be of different polarity from other four voltages with respect to the ground voltage.

By such bias application, the residual toner is once removed from the surface of the photosensitive drum 20 and gathered on the brush roller 71. The toner gathered on the brush roller 71 is rotated by the brush roller 71 to face the charge electrode 73. The charge of the toner is adjusted by the charge electrode 73. The toner adjusted in charge is expelled onto the photosensitive drum 20.

At this time, since the applied voltages are thus determined, the toner can be transferred smoothly between the brush roller 71 and photosensitive drum 20. That is, the residual toner is gathered on the brush roller 71 only temporarily. It is not accumulated permanently on the brush roller 71. Further, as shown in formula (2), the absolute value |V2| of the applied voltage to the charge electrode 73 is set at a sufficiently large value. Therefore, the toner charge quantity is adjusted strongly by the charge electrode 73.

Figure 3:
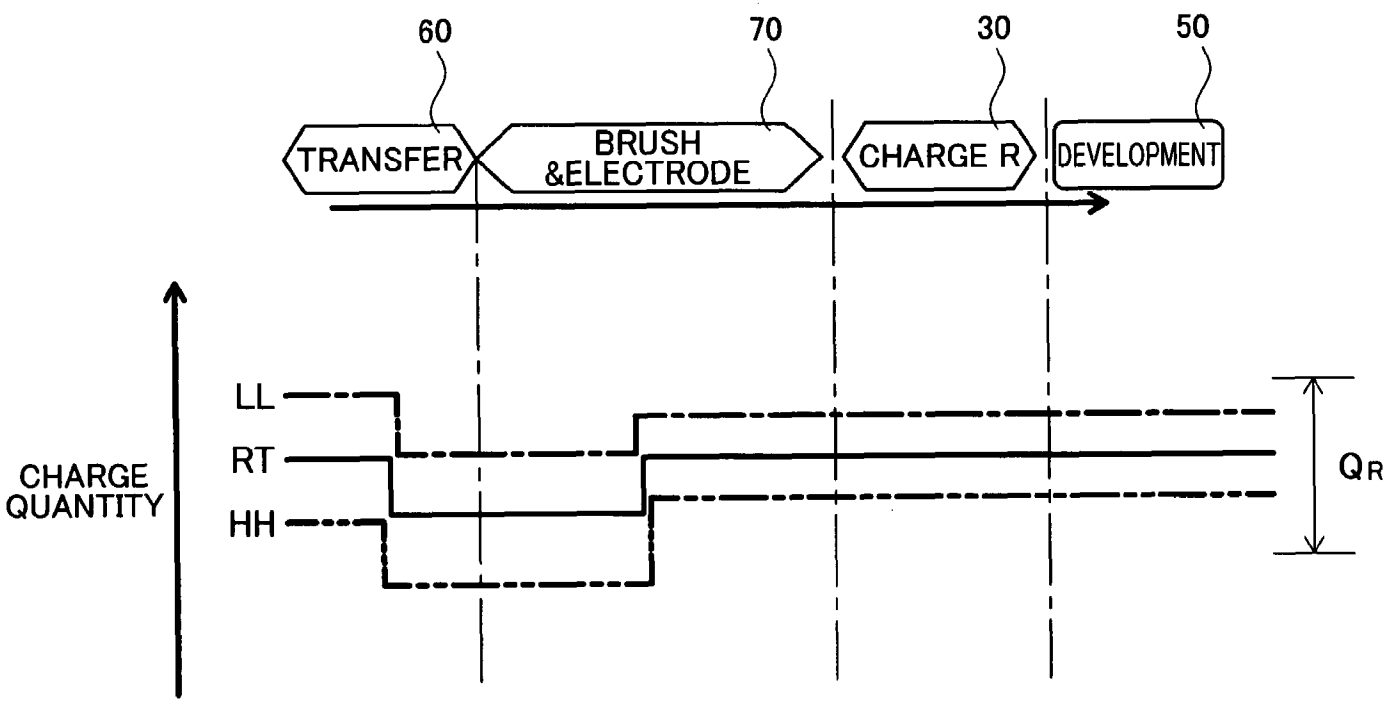
FIG. 3 is an explanatory diagram of transition of charge quantity of toner.

Generally, the toner charge quantity supplied onto the photosensitive drum 20 from the developing apparatus 50 varies as shown in FIG. 3 in the process of passing through apparatuses. First, by passing the transferring apparatus 60, the charge quantity decreases significantly. Occasionally, the polarity may be inverted, and reversely polarized toner may appear. Further, as shown in FIG. 3, charging ability of toner particles varies significantly depending on the environment. In the diagram, "LL" refers to low temperature and low humidity, "RT" is room temperature (standard environment), and "HH" is high temperature and high humidity. Charging ability is particularly lowered in "HH" environment.

Accordingly, in the color printer 1 of the embodiment, the voltage applied to the charge electrode 73 is adjusted depending on the operation environment. That is, the controller 80 receives results of measurement from the environment measuring section 81, and controls the voltage to be applied by the power source 75. In the standard environment, for example, a medium voltage is applied. In "HH" environment, a high voltage is applied. Thus, the charge is adjusted strongly in particular in "HH" environment. Therefore, as shown in FIG. 3, a nearly desired-charge quantity $Q_R$ may be always obtained regardless of the environment.

The desired charge quantity of toner is within a range of the toner not sticking to the charging apparatus 30 and being recovered smoothly in the developing apparatus 50. This range $Q_R$ is indicated by a both-tipped arrow at the right end in FIG. 3. The toner charge quantity Q1 expelled from the charge controlling section 70 and sticking again to the photosensitive drum 20 is preferred to settle within this range. Accordingly, the controller 80 controls the voltage value of the power source 75 so that Q1 may settle in the range of $Q_R$. The average value of the toner charge quantity in the developing apparatus 50 is supposed to be Q0. The expelled toner charge quantity Q1 is controlled at least to settle in a range satisfying formula (3).

$$0.5\times Q0 \leqq Q1 \leqq 2\times Q0 \quad (3)$$

The direction of sign of inequality in formula (3) is expressed by arranging the charge quantities Q0, Q1 in absolute values. In formula (3), since 0.5×Q0≦Q1, adhesion of toner to the charging apparatus 30 is suppressed. Since Q1≦2×Q0, further, the toner is recovered more securely in the developing apparatus 50. As a result, misexposure (obstruction) due to toner remaining on the photosensitive drum 20 can be suppressed.

Therefore, in the color printer 1 of the embodiment, the residual toner is processed as follows. First, the residual toner adheres to the surface of photosensitive drum 20, and faces the charge controlling section 70. At this time, it is leveled by the brush roller 71 contacting with the photosensitive drum 20. Further, an AC bias of average voltage V1 is applied to the brush roller 71. The residual toner is gathered on the brush roller 71. The gathered toner is carried by the rotation of the brush roller 71.

The toner gathered on the brush roller 71 faces the charge electrode 73. A stronger DC bias is applied to the charge electrode 73 than to the brush roller 71. Hence, the toner charge quantity adhering to the brush roller 71 is adjusted. In this embodiment, further, the operation environment is measured by the environment measuring section 81. The controller 80 receives the result, and controls the intensity of the bias of the charge electrode 73. Therefore, regardless of original charge quantity of residual toner or changes in operation environment, the charge quantity of residual toner is adjusted in a proper range. If the residual toner includes reversely polarized particles, the polarity is corrected. Further, the toner adjusted in charge is expelled to the photosensitive drum 20.

The toner adhering again to the photosensitive drum 20 passes through the charging apparatus 30. At this time, the charge quantity of residual toner is adjusted to a value not adsorbed by the charging apparatus 30. Therefore, the charging apparatus 30 is not contaminated. Further, the residual toner faces the developing apparatus 50. At this time, the charge quantity of residual toner is a value suited to recovery in the developing apparatus 50. Therefore, it is smoothly recovered by the developing apparatus 50. Further, the residual toner may be mixed in the toner in the developing apparatus 50, and can be presented again for development.

For trial, a specified bias was applied to the charge controlling section 70 of the color printer 1 of the embodiment, and the toner charge quantity was measured. In this experiment, the bias applied to the brush roller 71 was set as follows. This bias is a superimposed voltage of DC and AC. The AC component Vpp was 300 V. The DC component Vdc was −100 V with respect to the potential of the photosensitive drum 20. More specifically, the AC component was rectangular wave of frequency f=100 Hz and duty=50%. By varying presence or absence of charge electrode 73 and changing the bias magnitude, changes of toner charge quantity were measured.

The method of measuring the toner charge quantity is explained below. First of all, the weight of the measurement container is measured. This weight is W1 (gram). An electron meter is connected to the conducting section of the portion formed of the toner layer. As the portion formed of the toner layer, for example, a developing roller may be used. The electron meter is, for example, Digital Electrometer TR8652 manufactured by Advantest.

The measurement container is coupled to an aspirator. The toner is sucked from the suction port of the measurement container. At the same time, the charge quantity varying at the time of suction is measured by the electron meter. The measured charge quantity is C (coulomb). The weight of the measurement container after suction is measured. This weight includes the weight of the toner captured by suction. This weight is W2 (gram). By using the measured values, the toner charge quantity Qt is calculated in the following formula (4).

$$Qt=C/(W2-W1)\ \text{(coulomb/gram)} \quad (4)$$

Figure 4:
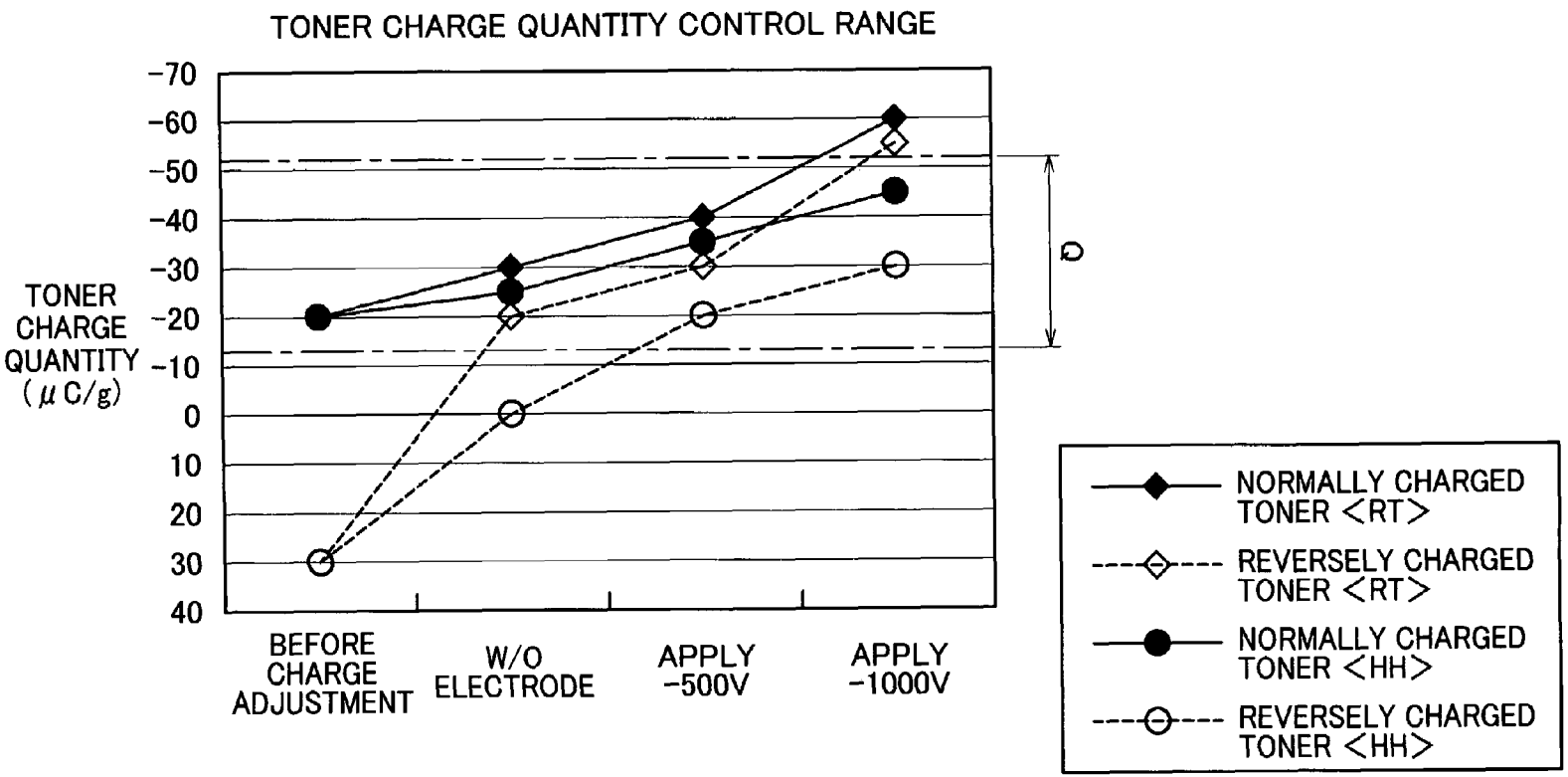
FIG. 4 is an explanatory diagram of control range of toner charge quantity.

Results measured in this method are shown in FIG. 4. The horizontal axis in the diagram denotes the applied voltage of the charge electrode 73, and the vertical axis represents the toner charge quantity. The leftmost two points show the toner charge quantity before charge adjustment. That is, the toner charge quantity before facing the charge controlling section 70 is shown. The black square and circle marks represent examples of toner charged in normal polarity. The white square and circle marks represent examples of toner charged in opposite polarity. The square marks indicate results of measurement during operation under normal environment (20 to 25° C., 50 to 60%). The circle marks indicate results of measurement during operation in high temperature and high humidity environment (30° C., 85%).

The second, third and fourth rows in the direction of the horizontal axis show values of toner charge quantity after passing through the charge controlling section 70. For example, the second row on the horizontal axis shows the charge controlling section 70 not having charge electrode 73. That is, it shows the toner charge quantity passing through the charge controlling section 70 by the brush roller 71 only. Or it may be also a case of not applying voltage at all to the charge electrode 73. The third row on the horizontal axis shows a case of applying −500 V to the charge electrode 73. The fourth row on the horizontal axis shows a case of applying −1000 V to the charge electrode 73.

As shown in FIG. 4, in any case, the charge quantity is increased as compared with the level before charge adjustment. In the diagram, the range of Q is a range of electric charge suited to recovery in the developing apparatus 50. That is, it is a range of an example of realizing the arrow $Q_R$ in FIG. 3. As known from the diagram, if the applied voltage to the charge electrode 73 is fixed at a specific value, it is not appropriate. That is, the toner charge quantity cannot be adjusted in a sufficiently appropriate range in all conditions.

By contrast, in the color printer 1 of the embodiment, the applied voltage V2 of the charge electrode 73 can be adjusted depending on the environmental condition. For example, in the standard environment, V2 is −500 V. In high temperature and high humidity environment, V2 is −1000 V. Thus, even in the toner deviated in normal polarity and opposite polarity; the toner charge quantity can be securely controlled within an appropriate range.

Results of image evaluation by the color printer 1 of the embodiment are explained by referring to FIG. 5. Herein, the average surface potential V0 after transferring of the photosensitive drum 20, the average voltage V1 applied to the brush roller 71, the amplitude Vpp of AC component applied to the brush roller 71, the voltage V2 applied to the charge electrode 73, and the average value Q0 of toner charge quantity in the developing apparatus 50 were determined as shown in the diagram. The AC component applied to the brush roller 71 is a rectangular wave of frequency f=100 Hz, and duty=50%. The environmental conditions "RT", "LL", and "HH" are respectively RT: 20 to 25° C., 50 to 60%, "LL": 15° C., 10%, and "HH": 30° C., 85%.

In each condition, the method of image evaluation is as follows. In evaluation, image defect and image noise have been also confirmed to occur corresponding to the causative phenomena. Such phenomena include toner drop, dirt on charging roller, and misexposure due to residual toner on photosensitive body 20.

To evaluate image defect by toner drop, printing 100 halftone dot images, image defect by toner drop was visually checked. Halftone dot images are total uniform (monochrome) patterns of density of 10 to 30%. The standard of each evaluation symbol is as follows.

○: less than 1 sheet of image defect out of 100 sheets.

Δ: less than 5 sheets of image defect out of 100 sheets.

X: same as or more than 5 sheets of image defect out of 100 sheets.

To evaluate unevenness of density by dirt on charging roller, printing 3000 halftone dot images similarly, image noise (unevenness of density) was visually checked. The standard of each evaluation symbol is as follows.

○: no image noise occurs.

Δ: no image noise occurs up to 1000 sheets of printing (practically acceptable).

X: image noise occurs within 1000 sheets of printing.

To evaluate noise by misexposure, printing 100 halftone dot images similarly; image noise (unevenness of density or after-image) was visually checked. The standard of each evaluation symbol is as follows.

○: no image noise occurs.

Δ: no image noise occurs up to 20 sheets of printing (practically acceptable).

X: image noise occurs within 20sheets of printing.

In FIG. 5, results of example 1 to example 10 satisfy both formula (1) and formula (3). Results of image evaluation were favorable in all of them. Formula (1) and formula (3) are as follows.

$$|V0|<|V1|<|V2| \quad (1)$$

$$0.5\times Q0 \leqq Q1 \leqq 2\times Q0 \quad (3)$$

On the other hand, examples 11 to 20 fail to satisfy at least either formula (1) or formula (3) As a result, some image defects were observed in all of them.

In examples 11, 14, and 17, the value of V2 was extremely increased. Hence, not satisfying formula (3), the relation was Q1>2×Q0. As a result, although all examples were in a practically acceptable range, image noise was caused by misexposure. In examples 12, 15, and 18, the value of V1 was 0 V. Hence, not satisfying formula (1), the relation was |V0|>|V1|. As a result, the toner transfer was not smooth, and an image defect due to tone drop occurred. In examples 13, 16, and 19, the value of V2 was decreased. In example 20, the value of V2 was in opposite polarity. They fail to satisfy formula (1), and the relation was |V1|>|V2|. Hence, the transfer of toner from brush roller 71 to photosensitive drum 20 was not smooth. As a result, the toner was accumulated on the brush roller 71, and image defect due to toner drop occurred. Further in examples 19 and 20, in the experiment under HH environment worsening the toner charging ability, the toner charge quantity was extremely decreased. As a result, unevenness of density due to contamination of charging roller occurred.

As described specifically herein, according to the color printer 1 of the embodiment, since the charge adjusting section 70 is provided, the charge quantity of residual toner is adjusted. The charge adjusting section 70 includes the brush roller 71 and charge electrode 73. A medium AC bias is applied to the brush roller 71. Therefore, the toner can be gathered and expelled smoothly. A DC bias is applied to the charge electrode 73. Its magnitude is controlled depending on the result of the environment measuring section 81. Therefore, the intensity of bias is selected depending on the charging ability of the toner. The toner expelled from the charge adjusting section 70 is adjusted to an appropriate charge quantity. That is, the toner slips out without adhering to the charging apparatus 30. It is hence recovered sufficiently in the developing apparatus 50. As a result, in spite of the cleaner-less image forming apparatus using the contact type charging apparatus, the toner can be securely recovered in the developing apparatus without contaminating the charging apparatus.

According to the image forming apparatus of the invention, residual toner after transfer contacts with the contact-rotating member before facing the charger. At this time, the residual toner is collected to the contact-rotating member. Further, the collected toner is placed opposite to the electrode. At this time, since a voltage is applied by an electrode voltage application section to the electrode, the charging state of the collected toner is adjusted. Polarity of the voltage applied to the electrode with respect to the average voltage of the surface of the photosensitive body after transfer is the same as the charge polarity of the toner at developing. Hence the charging state of the residual toner gets closer to the charging state of the toner at development. Therefore, in spite of charging apparatus of the contact type, the residual toner is hardly adhered to the charging apparatus. Hence, in the cleaner-less image forming apparatus using the contact type charging apparatus, an image forming apparatus capable of collecting residual toner securely in the developing apparatus without contaminating the charging apparatus is realized.

In the present invention, it is preferable that the contact-rotating member and the electrode are in noncontact with each other. Accordingly, there is no risk that the toner adhered to the contact-rotating member is scraped off by the electrode. Therefore, the toner can hardly be adhered to the electrode.

In the present invention, otherwise, it is preferable that an invasion quantity of the area where the contact-rotating member contacts with the electrode is smaller than that of the area where the contact-rotating member contacts with the photosensitive body. That is, the distance between the rotation center of the contact-rotating member and the surface of the electrode is longer than the distance between the rotation center of the contact-rotating member and the surface of the photosensitive body. Accordingly, this can prevent the electrode from scraping off toner collected by the contact-rotating member. Therefore, the toner can hardly be adhered to the electrode.

In the present invention, preferably an environmental sensor to output environmental information is equipped, and the first voltage applying section increases absolute value of difference between the voltage applied to the electrode and the average voltage of the surface of the photosensitive body after transferring in high temperature or high humidity environment compared with in low temperature or low humidity environment. Charging ability of toner is particularly lowered in the high temperature or high humidity environment. That is, the toner charge quantity is low even if an equal voltage to that in the low temperature or low humidity environment is applied. According to the invention, therefore, the charging state can be kept in almost the same level regardless of the environmental condition.

In the present invention, it is also desirable that a second voltage applying section for applying voltage to the contact-rotating member is equipped, and average voltage that the second voltage applying section applies to the contact-rotating member is in between voltage that the first voltage applying section applies to electrode and average voltage of the surface of the photosensitive body after transferring. Accordingly, residual toner remaining on the photosensitive body is attracted to the contact-rotating member. Especially the toner of which the charge quantity is extremely lowered or of opposite polarity is attracted much more than other residual toner. Thus, the charging state of the residual toner can be adjusted more securely.

In the present invention, it is also desirable that the charge quantity of the toner expelled from the contact-rotating member onto the photosensitive body is in the range from 0.5 times to twice charge quantity of the toner at developing. Thus, toner of which the charge quantity is extremely lowered or of opposite polarity is not contained on the photosensitive body after passing the contact-rotating member. Thus, there is little possibility that the toner is adhered onto the charger even when the toner faces the charger with rotating of the photosensitive body. Furthermore, when the toner is faced the developer, it is securely collected by the developer.

The present embodiment is disclosed only by way of an example, and the present invention is not limited thereto. Rather, various modifications and changes may of course be made in the invention, without departing from the spirit of the invention.

For example, in the above embodiment, the brush roller 71 rotates in the counter-direction to the photosensitive drum 20. However, the rotating direction is not limited to the counter-direction only. The shape or configuration of the charge electrode 73 is not limited, but it may be disposed anywhere near the brush roller 71.

The condition for controlling the applied voltage to the charge electrode 73 is not limited to the operation environment. It is preferred to be controlled depending on various conditions relating to the toner charge quantity or charging ability. In the embodiment, the invention is applied to the color printer, but not limited to this; it may be also applied to a copier, a facsimile apparatus, etc. Not limited to the color printer, it may be also applied to monochromatic apparatus, or it may be designed to an apparatus in which toner image is transferred directly on a recording sheet without using an intermediate transfer belt.

According to the image forming apparatus of the invention, being a cleaner-less image forming apparatus using the contact type charging apparatus, the toner can be securely recovered in the developing apparatus without contaminating the charging apparatus.

What is claimed is:

1. An image forming apparatus comprising:

a photosensitive body;

a charger to charge a surface of the photosensitive body;

an exposure apparatus to form an electrostatic latent image on the surface of the photosensitive body;

a developing apparatus to develop the electrostatic latent image on the photosensitive body utilizing toner;

a transferring apparatus to transfer a toner image from the photosensitive body onto a to-be-transferred body;

a contact-rotating member which is conductive and contacts the photosensitive body at a position downstream of the transferring apparatus and upstream of the charger in respect to a moving direction of the surface of the photosensitive body, to temporarily collect at least a portion of toner remaining on the photosensitive body without being transferred, and to expel the collected toner directly onto the photosensitive body;

an electrode facing the contact-rotating member at a position other than the contact position of the contact-rotating member and the photosensitive body; and a first voltage applying section to apply voltage to the electrode, wherein a polarity of the voltage applied to the electrode by the first voltage applying section with respect to an average voltage of the surface of the photosensitive body after transferring is the same as a charging polarity of the toner at developing.

2. The image forming apparatus according to claim 1, wherein the contact-rotating member and the electrode do not contact each other.

3. The image forming apparatus according to claim 1, wherein the contact-rotating member contacts the electrode, and an invasion quantity of an area where the contact-rotating member contacts the electrode is smaller than that of an area where the contact-rotating member contacts the photosensitive body.

4. The image forming apparatus according to claim 1, further comprising an environmental sensor to output environmental information, wherein the first voltage applying section increases an absolute value of a difference between the voltage applied to the electrode and the average voltage of the surface of the photosensitive body after transferring in a high temperature or a high humidity environment compared with a low temperature or a low humidity environment.

5. The image forming apparatus according to claim 1, wherein a charge quantity of the toner expelled from the contact-rotating member onto the photosensitive body is in a range from 0.5 times to twice a charge quantity of the toner at developing.

6. The image forming apparatus according to claim 1, further comprising:

a second voltage applying section to apply voltage to the contact-rotating member, wherein an average voltage V1 to be applied by the second voltage applying section to the contact-rotating member, a voltage V2 to be applied by the first voltage applying section to the electrode, and an average voltage V0 of the surface of the photosensitive body after transferring are in the following relation:

$$|V0|<|V1|<|V2|.$$

7. The image forming apparatus according to claim 6, wherein the voltage to be applied by the second voltage applying section to the contact-rotating member is a superimposed voltage of direct current and alternating current, and when peak values are V1p and V1q wherein |V1p|<|V1q, the following relation is established:

$$|V1p|<|V0|<|V1|<|V1q|<|V2|.$$

8. The image forming apparatus according to claim 1, wherein the electrode is fixed in a predetermined position.

9. A charge controlling apparatus to adjust a charge of a toner on a photosensitive body, comprising:

a photosensitive body to hold a developed toner image and to transfer the developed image to a recording medium;

a contact-rotating member which is conductive and is provided in contact with the photosensitive body, to temporarily collect at least a portion of toner on the photosensitive body, and to expel the collected toner directly onto the photosensitive body;

an electrode facing the contact-rotating member at a position other than the contact position of the contact-rotating member and the photosensitive body; and a first voltage applying section to apply a voltage to the electrode, wherein a polarity of the voltage to be applied to the electrode by the first voltage applying section with respect to an average voltage of the surface of the photosensitive body after transferring the developed image is the same as a charging polarity of the toner of the developed image.

10. The charge controlling apparatus according to claim 9, wherein the contact-rotating member and the electrode are not in contact with each other.

11. The charge controlling apparatus according to claim 9, wherein the contact-rotating member contacts the electrode, and an invasion quantity of an area where the contact-rotating member contacts the electrode is smaller than an area where the contact-rotating member contacts the photosensitive body.

12. The charge controlling apparatus according to claim 9, further comprising, an environmental sensor to output environmental information, wherein the first voltage applying section increases an absolute value of a difference between the voltage applied to the electrode and the average voltage of the surface of the photosensitive body after transferring the developed image in a high temperature or a high humidity environment compared with a low temperature or a low humidity environment.

13. The charge controlling apparatus according to claim 9, wherein a charge quantity of the toner expelled from the contact-rotating member onto the photosensitive body is in a range from 0.5 times to twice charge quantity of toner at developing.

14. The charge controlling apparatus according to claim 9, further comprising, a second voltage applying section to apply a voltage to the contact-rotating member, wherein an average voltage Vito be applied by the second voltage applying section to the contact-rotating member, a voltage V2 to be applied by the first voltage applying section to the electrode, and an average voltage V0 of the surface of the photosensitive body after transferring the developed image are in the following relation:

$$|V0|<|V1|<|V2|.$$

15. The charge controlling apparatus according to claim 14, wherein the voltage to be applied by the second voltage applying section to the contact-rotating member is a superimposed voltage of a direct current and an alternating current, and when peak values are V1p and V1q wherein |V1p<|V1q|, the following relation is established:

$$|V1p|<|V0|<|V1|<|V1q|<|V2|.$$

16. The charge controlling apparatus according to claim 9, wherein the electrode is fixed in a predetermined position.

17. An image forming methods comprising:

charging a surface of a photosensitive body;

forming an electrostatic latent image on the surface of the photosensitive body by exposure;

forming a toner image by developing the electrostatic latent image on the photosensitive body;

transferring the toner image on the photosensitive body onto a to-be-transferred body, such that an amount of toner remains on the photosensitive body;

collecting temporarily at least part of the toner remaining on the photosensitive body by a contact-rotating member provided in contact with the photosensitive body;

applying voltage to an electrode facing the contact-rotating member at a position other than the contact position of the contact-rotating member and the photosensitive body; and expelling the toner collected by the contact-rotating member directly onto the photosensitive body, wherein a polarity of the voltage applied to the electrode with respect to an average voltage of the surface of the photosensitive body after transferring is the same as a charging polarity of the toner at developing.

18. The image forming method according to claim 17, wherein the contact-rotating member and the electrode are not in contact with each other.

19. The image forming method according to claim 17, wherein the contact-rotating member contacts with the electrode, and an invasion quantity of an area where the contact-rotating member contacts the electrode is smaller than an area where the contact-rotating member contacts the photosensitive body.

20. The image forming method according to claim 17, further comprising, obtaining environmental information, wherein an absolute value of a difference between the voltage applied to the electrode and the average voltage of the surface of the photosensitive body after transferring is increased in a high temperature or a high humidity environment compared with a low temperature or a low humidity environment.

21. The image forming method according to claim 17, wherein a charge quantity of the toner expelled from the contact-rotating member onto the photosensitive body is in a range from 0.5 times to twice charge quantity of toner at developing.

22. The image forming method according to claim 17, wherein an average voltage V1 to be applied by the second voltage applying section to the contact-rotating member, a voltage V2 to be applied by the first voltage applying section to the electrode, and an average voltage V0 of the surface of the photosensitive body after transferring are in the following relation:

$$|V0|<|V1|<|V2|.$$

23. The image forming method according to claim 17, wherein the electrode is fixed in a predetermined position.

* * * * *

UNITED STATES PATENT AND TRADEMARK OFFICE

CERTIFICATE OF CORRECTION

PATENT NO. : 7,324,776 B2
APPLICATION NO. : 11/028746
DATED : January 29, 2008
INVENTOR(S) : Akira Hirota et al.

It is certified that error appears in the above-identified patent and that said Letters Patent is hereby corrected as shown below:

In the Claims:

In Claim 7, column 12, line 44, please replace "|V1p|<|V1q," with --|V1p|<|V1q|,--

In Claim 14, column 13, line 33, please replace the word "Vito" with --V1 to--

In Claim 17, column 13, line 53, please replace the word "methods" with --method,--

In Claim 22, column 14, line 51, please insert a comma --,-- after the word "transferring"

Signed and Sealed this

Seventeenth Day of June, 2008

JON W. DUDAS
*Director of the United States Patent and Trademark Office*